US006808363B2

(12) United States Patent
Darkins, Jr. et al.

(10) Patent No.: US 6,808,363 B2
(45) Date of Patent: Oct. 26, 2004

(54) SHROUD SEGMENT AND ASSEMBLY WITH CIRCUMFERENTIAL SEAL AT A PLANAR SEGMENT SURFACE

(75) Inventors: Toby George Darkins, Jr., Loveland, OH (US); Mary Ellen Alford, Cincinnati, OH (US); Mark Eugene Noe, Morrow, OH (US)

(73) Assignee: General Electric Company, Schenectady, NY (US)

( * ) Notice: Subject to any disclaimer, the term of this patent is extended or adjusted under 35 U.S.C. 154(b) by 65 days.

(21) Appl. No.: 10/325,760

(22) Filed: Dec. 20, 2002

(65) Prior Publication Data

US 2004/0120806 A1 Jun. 24, 2004

(51) Int. Cl.[7] ..... F01D 11/08

(52) U.S. Cl. ..... 415/139; 415/138; 415/173.1; 415/173.3; 415/200; 277/630; 277/637; 277/643

(58) Field of Search ..... 415/136, 138, 415/139, 135, 173.1, 173.3, 200; 277/628, 630, 637, 643

(56) References Cited

U.S. PATENT DOCUMENTS

| | | | | |
|---|---|---|---|---|
| 3,798,899 A | | 3/1974 | Hill | |
| 3,807,891 A | | 4/1974 | McDow et al. | |
| 3,966,353 A | | 6/1976 | Booher, Jr. et al. | |
| 4,193,738 A | | 3/1980 | Landis, Jr. et al. | |
| 4,325,647 A | | 4/1982 | Maier et al. | |
| 4,768,924 A | | 9/1988 | Carrier et al. | |
| 5,071,313 A | | 12/1991 | Nichols | |
| 5,074,748 A | | 12/1991 | Hagle | |
| 5,127,793 A | | 7/1992 | Walker et al. | |
| 5,129,783 A | | 7/1992 | Hayton | |
| 5,387,082 A | * | 2/1995 | Matyscak | 415/139 |
| 5,388,962 A | | 2/1995 | Wygle et al. | |
| 5,562,408 A | | 10/1996 | Proctor et al. | |
| 6,000,906 A | | 12/1999 | Draskovich | |
| 6,113,349 A | * | 9/2000 | Bagepalli et al. | 415/139 |
| 6,142,734 A | | 11/2000 | Lee | |
| 6,325,593 B1 | * | 12/2001 | Darkins et al. | 415/115 |
| 6,412,784 B1 | * | 7/2002 | Cohen | 277/385 |
| 6,503,051 B2 | * | 1/2003 | Predmore | 415/135 |
| 6,554,563 B2 | * | 4/2003 | Noe et al. | 415/115 |
| 6,648,597 B1 | * | 11/2003 | Widrig et al. | 415/200 |
| 2003/0133790 A1 | * | 7/2003 | Darkins et al. | 415/139 |
| 2003/0185674 A1 | * | 10/2003 | Alford et al. | 415/173.1 |

* cited by examiner

*Primary Examiner*—Christopher Verdier
(74) *Attorney, Agent, or Firm*—David L. Narciso; Lee H. Sachs

(57) ABSTRACT

A turbine engine shroud segment having a body including a circumferentially arcuate radially inner surface defining a circumferential arc and a radially outer surface is provided, at least at one axially spaced apart outer surface edge portion surface, with a surface depression extending circumferentially across the outer edge portion and including a planar seal surface. The planar seal surface is spaced apart radially outwardly from the circumferential arc defining a spaced apart chord of the arc. The planar seal surface is joined with the segment body radially outer surface through an arcuate transition surface. In a circumferential assembly of a plurality of the shroud segments into a turbine engine shroud assembly, at least one of the outer surface edge portions and its respective depression portion and fluid seal surface is distinct axially from an axially juxtaposed engine member by a separation therebetween. A fluid seal member, including a fluid seal surface matched in shape with the planar seal surface of the segment, is retained in juxtaposition for contact with the segment planar seal surface along the separation, for example as a result of pressure loading during engine operation.

12 Claims, 4 Drawing Sheets

SHROUD SEGMENT AND ASSEMBLY WITH CIRCUMFERENTIAL SEAL AT A PLANAR SEGMENT SURFACE

The Government has rights in this invention pursuant to Contract No. F33615-97-C-2778 awarded by the Department of Air Force.

BACKGROUND OF THE INVENTION

This invention relates generally to turbine engine shrouds disposed about rotating articles and to their assemblies about rotating blades. More particularly, it relates to air cooled gas turbine engine shroud segments and to shroud assemblies, for example for use in the turbine section of a gas turbine engine, especially segments made of a low ductility material.

Typically in a gas turbine engine, a plurality of stationary shroud segments are assembled circumferentially about an axial flow engine axis and radially outwardly about rotating blading members, for example about turbine blades, to define a part of the radial outer flowpath boundary over the blades. In addition, the assembly of shroud segments is mounted in an engine axially between such axially adjacent engine members as nozzles and/or engine frames. As has been described in various forms in the gas turbine engine art, it is desirable to avoid leakage of shroud segment cooling air radially inwardly and engine flowpath fluid radially outwardly through separations between circumferentially adjacent shroud segments and between axially adjacent engine members. It is well known that such undesirable leakage can reduce turbine engine operating efficiency. Some current seal designs and assemblies include sealing members disposed in slots in shroud segments. Typical forms of current shrouds often have slots along circumferential and/or axial edges to retain thin metal strips sometimes called spline seals. During operation, such spline seals are free to move radially to be pressure loaded at the slot edges, generally by radially outer cooling air, and thus to minimize shroud segment to segment leakage. Because of the usual slot configuration, stresses are generated at relatively sharp edges. However as discussed below, current metallic materials from which the shroud segments are made can accommodate such stresses without detriment to the shroud segment. Examples of U.S. patents relating to turbine engine shrouds and such shroud sealing include U.S. Pat. Nos. 3,798,899—Hill; 3,807,891—McDow et al.; 5,071,313—Nichols; 5,074,748—Hagle; 5,127,793—Walker et al.; and 5,562,408—Proctor et al.

Metallic type materials currently and typically used to make shrouds and shroud segments have mechanical properties including strength and ductility sufficiently high to enable the shrouds to receive and retain currently used inter-segment leaf or spline seals in slots in the shroud segments without resulting in damage to the shroud segment during engine operation. Generally such slots conveniently are manufactured to include relatively sharp corners or relatively deep recesses that can result in locations of stress concentrations, sometimes referred to as stress risers. That kind of assembly can result in the application of a substantial compressive force to the shroud segments during engine operation. If such segments are made of typical high temperature alloys currently used in gas turbine engines, the alloy structure can easily withstand and accommodate such compressive forces without damage to the segment. However, if the shroud segment is made of a low ductility, relatively brittle material, such compressive loading can result in fracture or other detrimental damage to the segment during engine operation.

Current gas turbine engine development has suggested, for use in higher temperature applications such as shroud segments and other components, certain materials having a higher temperature capability than the metallic type materials currently in use. However such materials, forms of which are referred to commercially as a ceramic matrix composite (CMC) or monolithic ceramic materials, have mechanical properties that must be considered during design and application of an article such as a shroud segment. For example, CMC and monolithic ceramic type materials have relatively low tensile ductility or low strain to failure when compared with metallic materials. Therefore, if a CMC or monolithic ceramic type of shroud segment is manufactured with features such as relatively sharp corners or deep recesses to receive and hold a fluid seal, such features can act as detrimental stress risers. Tensile forces developed at such stress risers in that type segment material can be sufficient to cause failure of the segment.

Generally, commercially available CMC materials include a ceramic type fiber for example SiC, forms of which are coated with a compliant material such as BN. The fibers are carried in a ceramic type matrix, one form of which is SiC. Forms of monolithic ceramic materials, not reinforced with fibers, include SiC and $SiN_3$. Typically, those types of materials have a room temperature tensile ductility of no greater than about 1%, herein used to define and mean a low ductility material. For example, CMC type materials generally have a room temperature tensile ductility in the range of about 0.4–0.7%. This is compared with metallic materials currently used as shrouds, and supporting structure or hanger materials, that have a room temperature tensile ductility of at least about 5%, for example in the range of about 5–15%. Shroud segments made from CMC or monolithic ceramic type materials, although having certain higher temperature capabilities than those of a metallic type material, cannot tolerate the above described and currently used type of compressive forces generated in slots or recesses for fluid seals.

One typical form of a gas turbine engine includes a circumferential array of shroud segments disposed circumferentially about and spaced radially outwardly from tips of a plurality or stage of rotating blades to enable the blades to rotate freely inwardly from the shroud segments. During engine operation, as blade tips intermittently pass the radially inner surface of the shroud segments, variations in pressure forces tend to move or vibrate the segments axially inwardly and outwardly. When a shroud segment is made of a low ductility material, it is desirable to avoid sealing circumferentially extending separations between axially adjacent engine members in a manner that results in a stress riser, as discussed above. Therefore, it would be advantageous to dispose on or at a radially outer surface of the shroud segment bridging the separation a spline or leaf seal member that is, or is capable of becoming, flat or planar in juxtaposition with, or is forced to conform with, a radially outer surface of the shroud segment bridging the separation.

The radially inner surface of a shroud segment is arcuate circumferentially to cooperate in spaced-apart juxtaposition with inwardly rotating blades. Conveniently, such shroud segment generally is made with a radially outer surface that is generally arcuate. Therefore, the above-described variable pressure induced radial movement of the shroud segment during engine operation is particularly significant at the axial edge portions of the shroud segment at which such a bridging seal would be disposed. Disposition of a flat or planar seal surface on a surface that is other than flat or planar results in a point or axial line contact between such cooperating members, enhancing vibration and or stress concentration at or along such contact. Therefore, a shroud segment and assembly of shroud segments configured to receive and hold a circumferentially extending fluid seal at an axial edge portion of a shroud segment without generating detrimental stress or vibration at a point or line contact can enable advantageous use of low ductility shroud segments with fluid seals retained between axially adjacent engine members without resulting in operating damage to the brittle shroud segments.

BRIEF SUMMARY OF THE INVENTION

The present invention, in one form, provides a shroud segment for use in a turbine engine shroud assembly comprising a plurality of circumferentially disposed shroud segments. Each shroud segment comprises a shroud segment body including a circumferentially arcuate radially inner surface defining a circumferential arc, and a radially outer surface. The radially outer surface extends between a first, axially forward, outer surface edge portion and a second, axially aft, outer surface edge portion axially spaced apart from the first outer surface edge portion. At least one of the axially spaced apart outer surface edge portions comprises a surface depression portion extending circumferentially across the outer surface edge portion and including a planar seal surface. The planar seal surface is spaced apart radially outwardly from the circumferential arc of the segment body radially inner surface, defining a spaced-apart chord of the circumferential arc. The planar seal surface is joined with the shroud body radially outer surface through an arcuate transition surface.

In a turbine engine shroud assembly comprising a plurality of circumferentially disposed shroud segments as described above, at least one of the first and second axially spaced apart outer surface edge portions is distinct axially from a surface of an axially juxtaposed adjacent engine member by a circumferential separation therebetween. A fluid seal member, including a fluid seal member surface that is planar or formable to planar, is retained in the surface depression and extends circumferentially along and bridges the separation. The fluid seal member surface that is planar or formable to planar is in juxtaposition for contact with the planar surface depression portion of the shroud segment body along the separation.

BRIEF DESCRIPTIONS OF THE DRAWINGS

DETAILED DESCRIPTION OF THE INVENTION

The present invention will be described in connection with an axial flow gas turbine engine for example of the general type shown and described in the above identified Proctor et al patent. Such an engine comprises a plurality of cooperating engine members and their sections in serial flow communication generally from forward to aft, including one or more compressors, a combustion section, and one or more turbine sections disposed axisymmetrically about a longitudinal engine axis. Accordingly, as used herein, phrases using the term "axially", for example "axially forward" and "axially aft", are general directions of relative positions in respect to the engine axis; phrases using forms of the term "circumferential" refer to circumferential disposition generally about the engine axis; and phrases using forms of the term "radial", for example "radially inner" and "radially outer", refer to relative radial disposition generally from the engine axis.

It has been determined to be desirable to use low ductility materials, such as the above-described CMC or monolithic ceramic type materials, for selected articles or components of advanced gas turbine engines, for example non-rotating turbine shroud segments. However, because of the relative brittle nature of such materials, conventional mechanisms currently used for carrying fluid seals with metallic forms of such components cannot be used: relatively high mechanical, thermal and contact stresses can result in fracture of the brittle materials. Forms of the present invention provide article configurations and mechanisms for holding fluid seals to articles or components made of such brittle materials in a manner that avoids application of undesirable stresses to the article.

Figure 4:
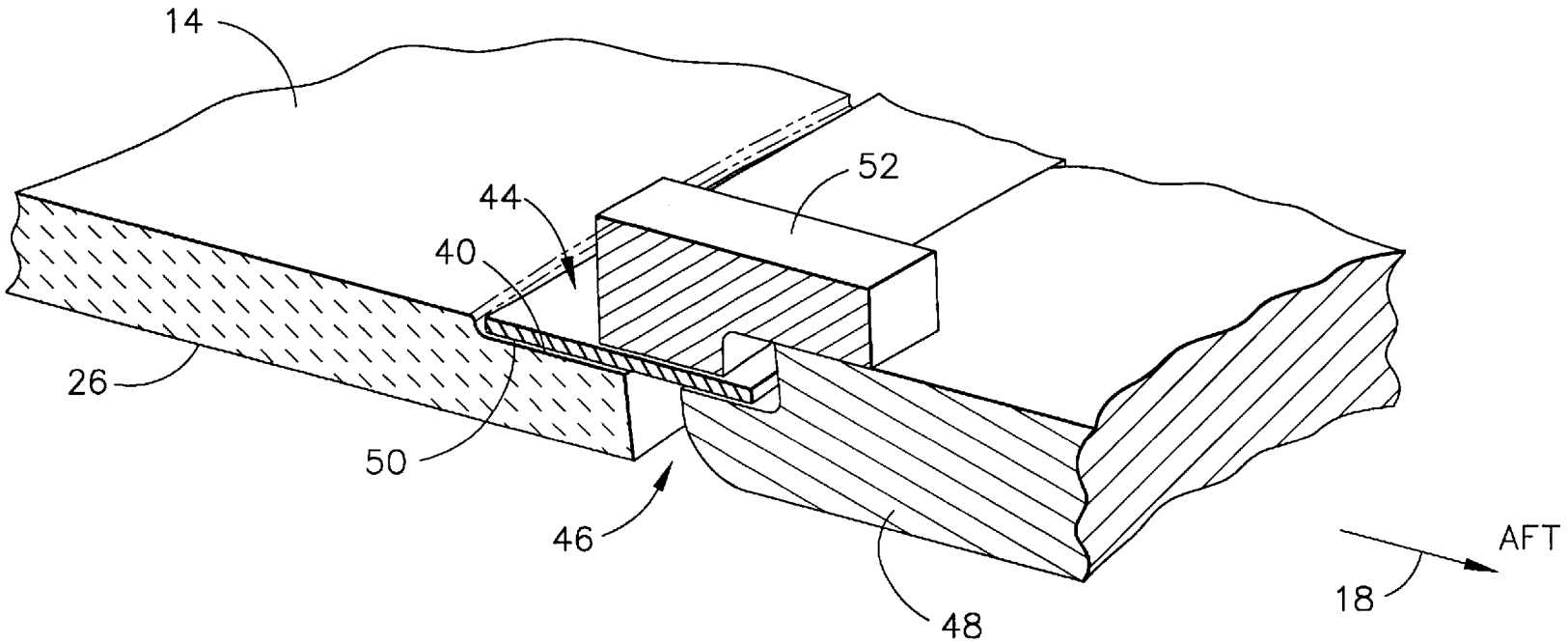
FIG. 4 is a fragmentary, sectional perspective view of a fluid seal member retained in a surface depression in a radially outer surface edge portion of a shroud member.

Forms of the present invention will be described in connection with an article in the form of a gas turbine engine turbine shroud segment, made of a low ductility material, and a circumferential assembly of shroud segments. Such assembly of shroud segments, shown generally at 10 in the fragmentary perspective diagrammatic view of FIG. 1, includes a plurality of circumferentially adjacent shroud segments, for example shown generally at 12 and 14. Such shroud segments are disposed between generally axially adjacent engine members, for example between a turbine nozzle and an engine frame, between spaced apart turbine nozzles, etc. One embodiment is shown in FIG. 4, described below. In the embodiments of the drawings, orientation of shroud segments 12 and 14 in a turbine engine, and of other adjacent engine members, is shown by engine direction arrows 16, 18, and 20 representing, respectively, the engine circumferential, axial, and radial directions.

Each shroud segment, for example 12 and 14, includes a shroud body 22 having body radially outer surface 24 and a circumferentially arcuate body radially inner surface 26 exposed to the engine flowstream during engine operation radially outwardly from rotating blades, one of which is represented diagrammatically at 28. Shroud body 22 can be supported from engine structure in a variety of ways (not shown). Each shroud segment body radially outer surface 24 extends at least between a pair of spaced apart, opposed outer surface edge portions. In shroud segment 14 of FIG. 1, one pair extends between a first axially forward outer surface edge portion shown generally at 30 and a second axially aft outer surface edge portion shown generally at 32, axially spaced apart from and opposed to first outer surface edge portion 30. Outer surface 24 also extends axially between circumferentially spaced apart and opposed edge portions shown generally at 34.

Figure 1:
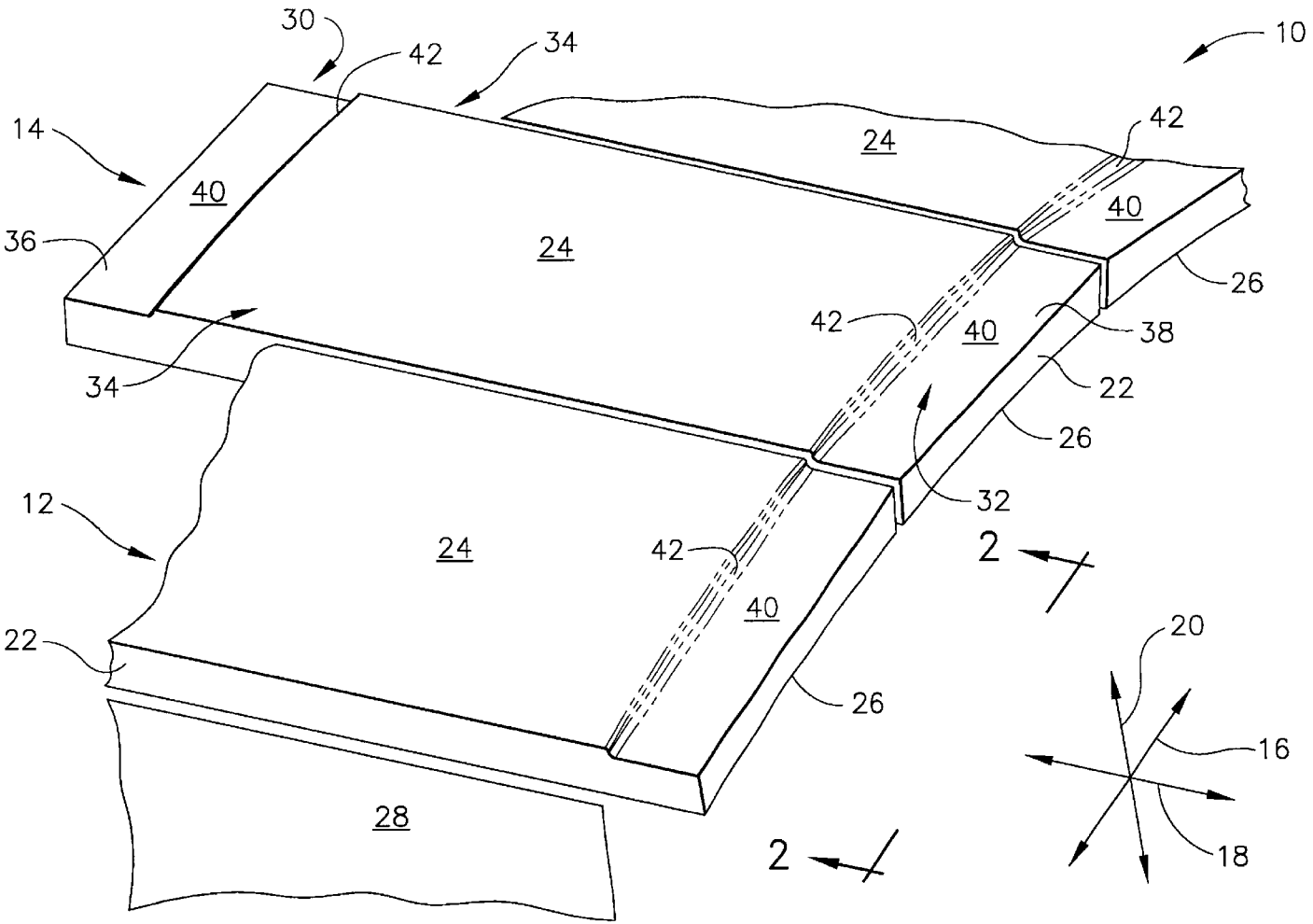
FIG. 1 is a fragmentary perspective diagrammatic view of a circumferential assembly of turbine engine shroud segments disposed about rotating turbine blades.

In respect to the above described radial pressure induced movement of the shroud segment as turbine blades rotate within the circumferential assembly of shroud segments, the axially aft edge portion of the shroud segment is more significantly affected. Therefore, although in the embodiment of FIG. 1, each of the first and second outer surface edge portions 30 and 32 includes, respectively, a depression portion 36 and 38, in other forms of the present invention only one, and primarily the axially aft edge portion, includes such a depression having a planar seal surface. Each such depression portion is in axial spaced apart juxtaposition with an adjacent engine member, for example a turbine rear frame 48 shown in FIG. 4 or an outer band of a turbine nozzle. In FIG. 1, each depression portion 36 and 38 includes a planar depression portion seal surface 40 generally circumferentially along across each outer surface edge portion 30 and 32. Each depression portion seal surface 40, intended to cooperate with a matching seal surface of a fluid seal member in a shroud assembly, is joined with the shroud body radially outer surface 24 through an arcuate, fillet-type transition surface 42. As used herein, arcuate means generally configured to avoid relatively sharp surface inflection shapes and a potential location of elevated stress concentrations. A depression portion, that generally is shallow in depth, can readily be generated in an outer surface edge portion by such mechanical material removal methods including surface grinding, machining, etc. Alternatively, such surface edge portion can be provided during manufacture of the shroud, for example as in casting.

Figure 2:
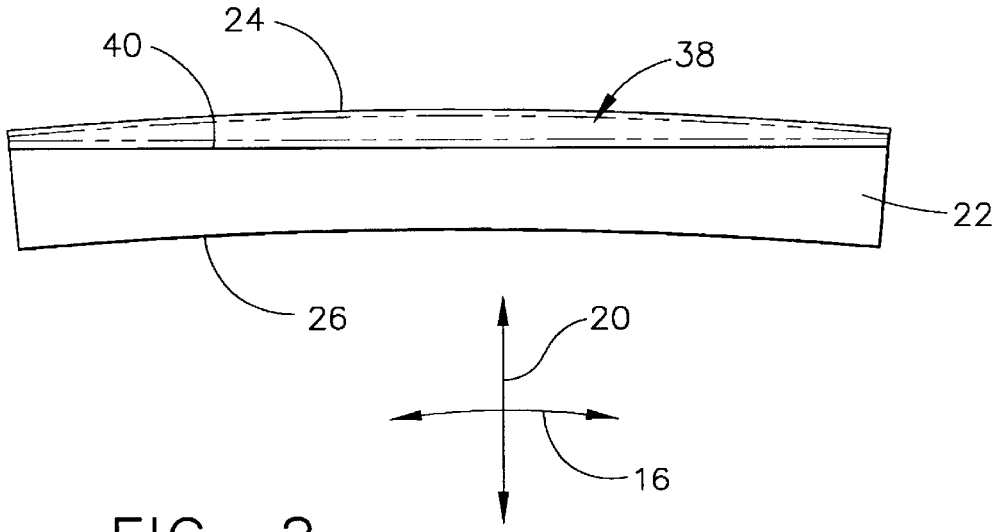
FIG. 2 is an axially aft view of a shroud segment of FIG. 1 shown along lines 2—2.

FIG. 2 is a view of shroud segment 14 from axially aft of FIG. 1, shown along lines 2—2, presenting the relationship between planar seal surface 40 of depression portion 38 and the circumferential arc defined by shroud body radially inner surface 26. As shown in FIG. 2, planar seal surface 40 is a chord of arc 26, though radially outwardly spaced-apart therefrom.

Figure 3:
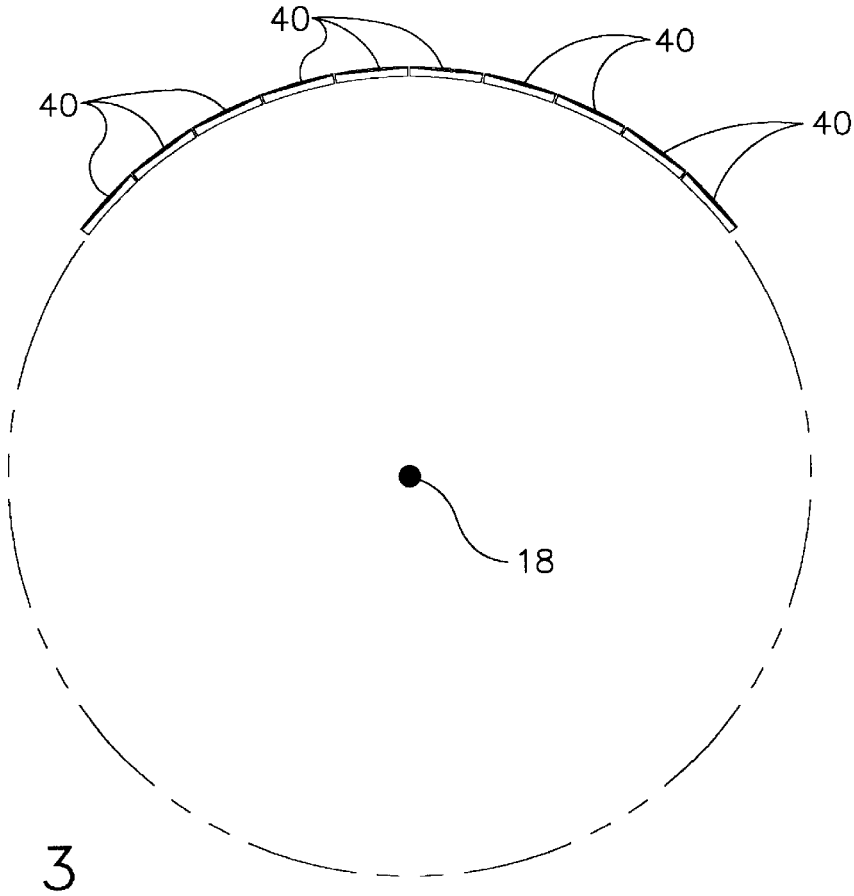
FIG. 3 is a diagrammatic view representing the circumferential disposition to define a general polygon shape of planar shroud segment planar seal surface about an engine axis.

FIG. 3 is a diagrammatic view representing the circumferential disposition of planar seal surfaces 40 of the plurality of shroud segments of a turbine shroud assembly when assembled circumferentially about engine axis 18 and about radially inner rotating blades 28. Together, such surfaces 40 define a general polygon shape with a number of sides equal to the number of shroud segments in the assembly. As shown in the fragmentary, sectional perspective view of FIG. 4, such a geometric configuration enables provision of cooperating surfaces of fluid seal members in a manner that provides a fluid seal along cooperating surfaces that are matched in shape to maintain a fluid seal during engine operation. Such a geometric combination of matching shaped surfaces enables the surfaces to move during engine operation radially together along a contact surface or circumferential line rather than a point or axial line that can produce a stress riser in the shroud segment. Such combination avoids the above-described vibration between such cooperating surfaces and the seal member 44 in FIG. 4. As used herein, "matched in shape" means that the shapes of the cooperating juxtaposed seal surfaces, during engine operation, are configured to register one with the other to define therebetween a substantially constant interface contact or spacing.

In the assembly of FIG. 4, one such fluid seal member is shown in perspective section generally at 44, disposed to seal circumferential separation 46 between a shroud segment such as 14 and an axially adjacent or juxtaposed engine member, for example a turbine rear frame or an outer band of a nozzle assembly, represented at 48. Fluid seal member 44 includes a fluid seal member surface 50 matched in shape, including meaning capable of being deformed or flexed to match in shape, with planar seal surface 40 of shroud segment 14. Therefore, fluid seal member 44 can be a generally rigid member or it can be a member sufficiently flexible to be flexed or deformed by typical pressure loading experienced by known fluid seals in a turbine engine. Fluid seal member 44 is retained in juxtaposition for pressure loading with such surface 40 along and axially bridging circumferential separation 46 between members 14 and 48 by a seal retainer, for example a bracket 52. In an example of one circumferential shroud segment assembly adjacent juxtaposed engine members, the number of fluid seal members 44 is equal to the number of shroud segments, defining the type of polygon represented in FIG. 3.

Figure 5:
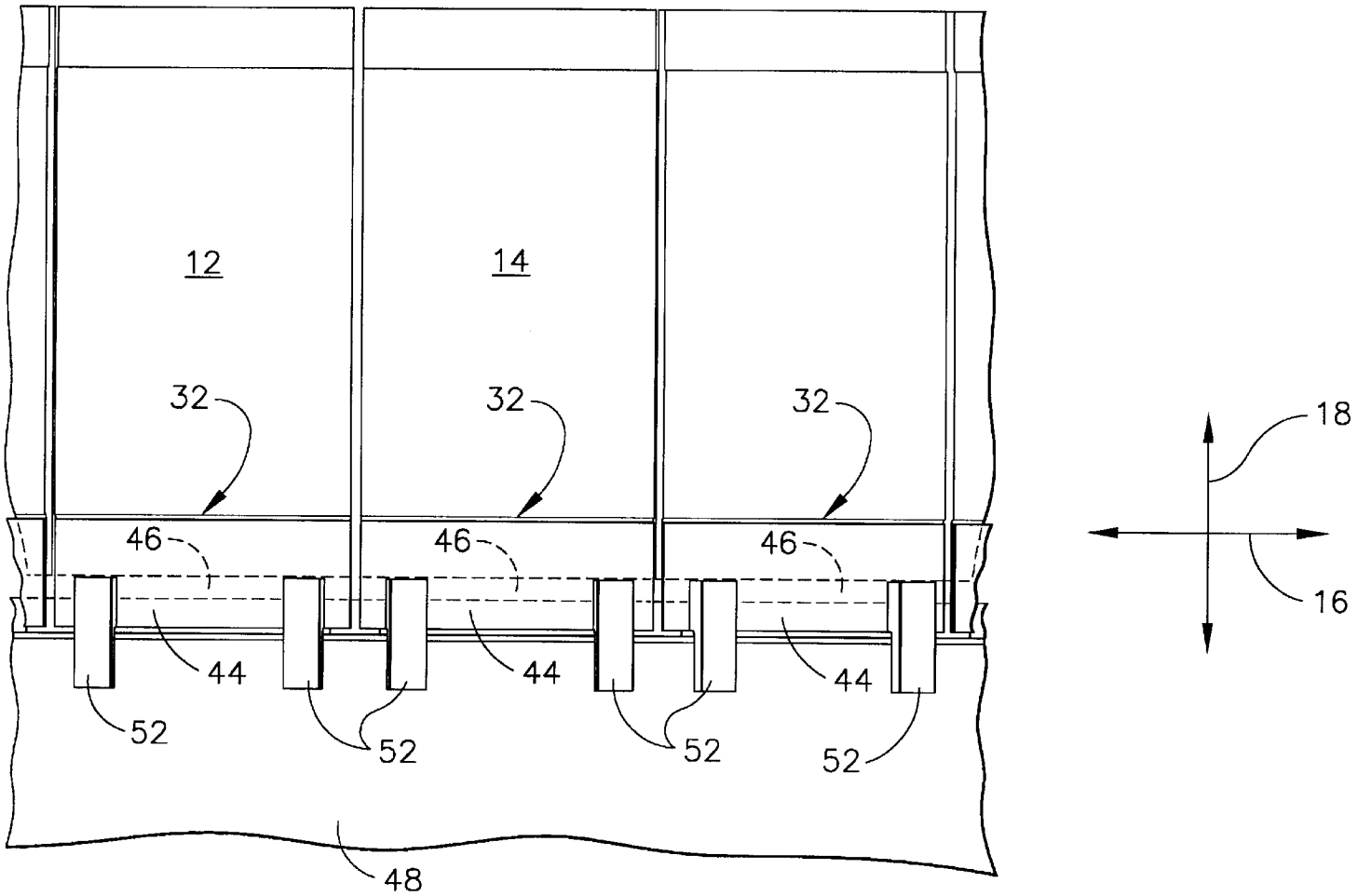
FIG. 5 is a diagrammatic fragmentary plan view of a circumferential assembly of the members of FIG. 4.

FIG. 5 is a diagrammatic fragmentary plan view of a circumferential assembly of the shroud segments, fluid seal members and seal retainers of the type shown in FIG. 4. A plurality of spaced-apart or segmented seal retainers 52 retain fluid seal members 44 at axially aft outer edge portion 32 of the shroud segments in juxtaposition with planar seal surfaces 40, shown in FIGS. 1–4, along separation 46 shown in phantom between the shroud segments and an axially adjacent engine member 48.

The combination of a planar fluid seal surface at least at one axial outer surface edge portion of a shroud segment in juxtaposition with a matching surface of a fluid seal member along a separation with an adjacent engine member enables use of shroud segments made of a low ductility material, for example a CMC or monolithic ceramic, without undesirable damage to the shroud segment from excessive stress during turbine engine operation. Although the present invention has been described in connection with specific examples, materials and combinations of structures and shapes, it will be understood that they are intended to be typical and representative of, rather than in any way limiting on, the scope of the present invention. Those skilled in the arts involved, for example relating to turbine engines, to metallic, nonmetallic and composite materials, and their combinations, will understand that the invention is capable of variations and modifications without departing from the scope of the appended claims.

What is claimed is:

1. A turbine engine shroud segment comprising a shroud body including a circumferentially arcuate radially inner surface defining a circumferential arc, and a radially outer surface extending between a first, axially forward, outer edge surface portion and a second, axially aft, outer surface edge portion axially spaced apart from the first outer surface edge portion, wherein at least one of the axially spaced apart outer surface edge portions comprises:

a surface depression portion extending circumferentially across the outer surface edge portion and including a planar seal surface;

the planar seal surface defining a chord of the circumferential arc defined by the shroud body radially inner surface, the chord being spaced apart radially outwardly from the circumferential arc;

the planar seal surface being joined with the shroud segment body radially outer surface through an arcuate transition surface.

2. The shroud segment of claim 1 in which the surface depression extends across the second, axially aft, outer surface edge portion.

3. The shroud segment of claim 1 in which the surface depression extends across the first, axially forward outer surface edge portion.

4. The shroud segment of claim 1 in which a surface depression extends across each of the first and second outer surface edge portions.

5. The shroud segment of claim 1 in which the shroud segment is made of a low ductility material having a tensile ductility measured at room temperature to be no greater than about 1%.

6. The shroud segment of claim 5 in which the low ductility material is a ceramic matrix composite material.

7. The shroud segment of claim 5 in which the low ductility material is a monolithic ceramic.

8. A turbine engine shroud assembly comprising a plurality of circumferentially disposed shroud segments, wherein:

the shroud segments comprise the shroud segment of claim 1 with at least one of the first and second axially spaced apart shroud body outer surface edge portions of a shroud segment being distinct axially from a surface of an axially juxtaposed adjacent engine member by a circumferential separation therebetween; and, a fluid seal member retained in the surface depression and extending circumferentially along and bridging the separation;

the fluid seal member including a fluid seal member surface in juxtaposition for contact with and matched in shape with the planar seal surface of the surface depression of the shroud segment along the separation.

9. The shroud assembly of claim 8 in which:

the plurality of shroud segments is a first number with the shroud segments assembled circumferentially, the shroud body arcuate radially inner surface defining a circle circumferentially;

the planar seal surfaces of the assembled shroud segments are axially spaced apart radially outwardly from the shroud body arcuate radially inner surfaces to define, radially outwardly about and spaced apart from the circle, a polygon shape having a second number of sides equal to the first number; and, a fluid seal member is retained at each segment depression portion seal surface with the respective seal surfaces of the fluid seal members and of the segment depression portions being in juxtaposition.

10. The shroud assembly of claim 8 in which the shroud segments are made of a low ductility material having a tensile ductility measured at room temperature to be no greater than about 1%.

11. The shroud assembly of claim 10 in which the low ductility material is a ceramic matrix composite material.

12. The shroud assembly of claim 10 in which the low ductility material is a monolithic ceramic.

* * * * *